US008480972B2

(12) United States Patent
May et al.

(10) Patent No.: US 8,480,972 B2
(45) Date of Patent: Jul. 9, 2013

(54) SHAFT FOR A SAMPLING PIPETTE

(75) Inventors: Yves May, Versailles (FR); Bernard Roussel, Bondy (FR)

(73) Assignee: Gilson S.A.S., Villiers-le-Bel (FR)

( * ) Notice: Subject to any disclaimer, the term of this patent is extended or adjusted under 35 U.S.C. 154(b) by 1412 days.

(21) Appl. No.: 11/838,384

(22) Filed: Aug. 14, 2007

(65) Prior Publication Data

US 2007/0297948 A1 Dec. 27, 2007

Related U.S. Application Data

(63) Continuation of application No. PCT/FR2006/000259, filed on Feb. 3, 2006.

(30) Foreign Application Priority Data

Feb. 18, 2005 (FR) ..... 05 01713

(51) Int. Cl.
*B01L 3/02* (2006.01)

(52) U.S. Cl.
USPC ..... 422/501; 73/864.01

(58) Field of Classification Search
USPC ..... 422/100, 501; 73/864.01–864.25
See application file for complete search history.

(56) References Cited

U.S. PATENT DOCUMENTS

| | | | |
|---|---|---|---|
| 4,474,071 | A | 10/1984 | Marteau d'Autry |
| 4,679,446 | A | 7/1987 | Sheehan et al. |
| 4,863,695 | A | 9/1989 | Fullemann |
| 6,021,680 | A | 2/2000 | Inagaki et al. |
| 6,499,363 | B1 | 12/2002 | Shigematsu et al. |
| 6,973,845 | B2 | 12/2005 | Bell |

FOREIGN PATENT DOCUMENTS

| | | |
|---|---|---|
| EP | 0078724 | 5/1983 |
| SU | 597411 | 3/1978 |
| WO | WO 93/08913 | 5/1993 |
| WO | WO 02/057016 | 7/2002 |
| WO | WO 03/002980 | 1/2003 |

OTHER PUBLICATIONS http://www.pipetman.com/Literature/Pipette%20Spec%20Charts.pdf.*

English translation of first Office Action issued in corresponding Chinese Application No. 200680005265.4 dated Jan. 16, 2009.

(Continued)

*Primary Examiner* — Jan Ludlow
(74) *Attorney, Agent, or Firm* — Foley & Lardner LLP

(57) ABSTRACT

A shaft for a sampling pipette includes a first cylindrical portion, a first annular shoulder, and a second annular shoulder. A first cross section of the first cylindrical portion has a first diameter. The first annular shoulder includes a first transition end adjacent the first cylindrical portion and a second cylindrical portion. A second cross section of the second cylindrical portion has a second diameter. The second annular shoulder includes a second transition end adjacent the first annular shoulder and a third cylindrical portion. A third cross section of the third cylindrical portion has a third diameter. The third diameter is greater than the second diameter which is greater than the first diameter. The second diameter and the third diameter are selected so that a pipette tip contacts the second cylindrical portion and the third cylindrical portion when the pipette tip is mounted on the shaft.

18 Claims, 4 Drawing Sheets

OTHER PUBLICATIONS

English translation of Rejection Decision issued in Chinese Patent Application No. 20068005265.4 dated Jul. 3, 2009.
International Search Report for PCT/FR2006/000259, dated May 17, 2006.
English translation of Official Action issued in Russian Patent Application No. 2007134513 dated Aug. 4, 2009.
EP Communication issued in European Patent Application No. 06709248.6 and dated Jul. 26, 2010 (English translation provided).
Notice of Preliminary Rejection issued on Korean Application 7020982/2007, dated Jun. 20, 2012 (English summary only).
Office Action issued in Japanese Patent Application No. 2007-555658 and dispatched on May 23, 2011. (English translation provided).
Notification of Reason for Rejection issued in Japanese Patent Application No. 2007-555658 and dispatched Sep. 12, 2011.
Office Action issued in Canadian Patent Application No. 2,598,337 and dated Feb. 28, 2012.
Office Action issued in Japanese Patent Application No. 2007-555658 and dated Mar. 5, 2012. (English translation not readily available).

* cited by examiner

SHAFT FOR A SAMPLING PIPETTE

CROSS-REFERENCE TO RELATED PATENT APPLICATIONS

This application is a continuation application of PCT application No. PCT/FR2006/000259, filed Feb. 3, 2006, which claims priority to French patent application No. 0501713, filed Feb. 18, 2005 the disclosures of which are incorporated by reference in their entirety.

FIELD

The field of the disclosure relates generally to laboratory pipettes. More specifically the disclosure relates to a laboratory pipette including a shaft that provides a reliable seal and that supports a consistent ejection force.

BACKGROUND

Laboratory pipettes may include one or more shafts that may be removable. The shafts generally include a tapered external shape that can be fitted with a removable, disposable tip. Conventionally, the tips are force fitted on the shaft and held in place by friction. A longitudinal section through the inner surface of the tip is generally conical with dimensions that provide a frictional contact with the shaft sufficient to support a suitable retaining force and an acceptable leak tightness. The tip generally is ejected using an appropriate device integrated into the pipette. An exemplary ejection mechanism is described in French Patent No. A-2 807 342.

Fully satisfactory usage properties, however, are not obtained using existing pipette shafts because the force necessary to force fit the tip on the pipette shaft is uncertain and can be very large because there is no means of limiting this force, because contact pressure at the sealing area may be low resulting in an uncertain and non-reproducible seal quality, and because the force to be applied to eject the tip is uncertain and can be very large if the tip was force fitted onto the shaft with a high force and insertion depth. Additionally, because the height and position of the sealing area are not sufficiently well controlled, there is no guarantee that the position of the tips is correct. This is particularly a problem using multi-channel pipettes that include several shafts in line with each other on which the corresponding number of tips is force fitted. There is no guarantee that the position of all the tips is correct, and therefore, that they all provide a satisfactory seal at the contact with the corresponding shaft.

PCT Publication No. WO 2003/002980 includes a proposal that the tip —shaft contact be sealed by providing an annular rim on the shaft. This rim provides a local thickening of the shaft at which a contact surface formed on the inner wall of the tip stops. However, this rim tends to make it more difficult to insert the tip and requires tips with an unusual conformation and deformability in the contact area between the tip and the rim. Therefore, what is need is a pipette shaft that provides an improved solution to the problems discussed above.

SUMMARY

In an exemplary embodiment, a shaft for a sampling pipette is provided. The shaft includes, but is not limited to, a first cylindrical portion, a first annular shoulder, and a second annular shoulder. The first cylindrical portion is configured to extend from a lower end of a pipette. A first cross section of the first cylindrical portion is perpendicular to a longitudinal axis of the pipette and has a first diameter. The first cylindrical portion includes an upper end opposite the lower end of the pipette. The first annular shoulder includes a first transition end adjacent the upper end of the first cylindrical portion, a second cylindrical portion, and a first end opposite the first transition end. A second cross section of the second cylindrical portion is perpendicular to the longitudinal axis of the pipette and has a second diameter. The second cylindrical portion extends from the first transition end to the first end. The second annular shoulder includes a second transition end adjacent the first end of the first annular shoulder, a third cylindrical portion, and a second end opposite the second transition end. A third cross section of the third cylindrical portion is perpendicular to the longitudinal axis of the pipette and has a third diameter. The third cylindrical portion extends from the second transition end to the second end. The second diameter is greater than the first diameter and the third diameter is greater than the second diameter. Additionally, the second diameter and the third diameter are selected so that a pipette tip contacts at least a portion of the second cylindrical portion and at least a portion of the third cylindrical portion when the pipette tip is mounted on the shaft.

In another exemplary embodiment, a sampling pipette is provided which includes a pipette body and a shaft that extends from the pipette body.

Other principal features and advantages of the invention will become apparent to those skilled in the art upon review of the following drawings, the detailed description, and the appended claims.

BRIEF DESCRIPTION OF THE DRAWINGS

Exemplary embodiments of the invention will hereafter be described with reference to the accompanying drawings, wherein like numerals denote like elements.

DETAILED DESCRIPTION

Figure 1:
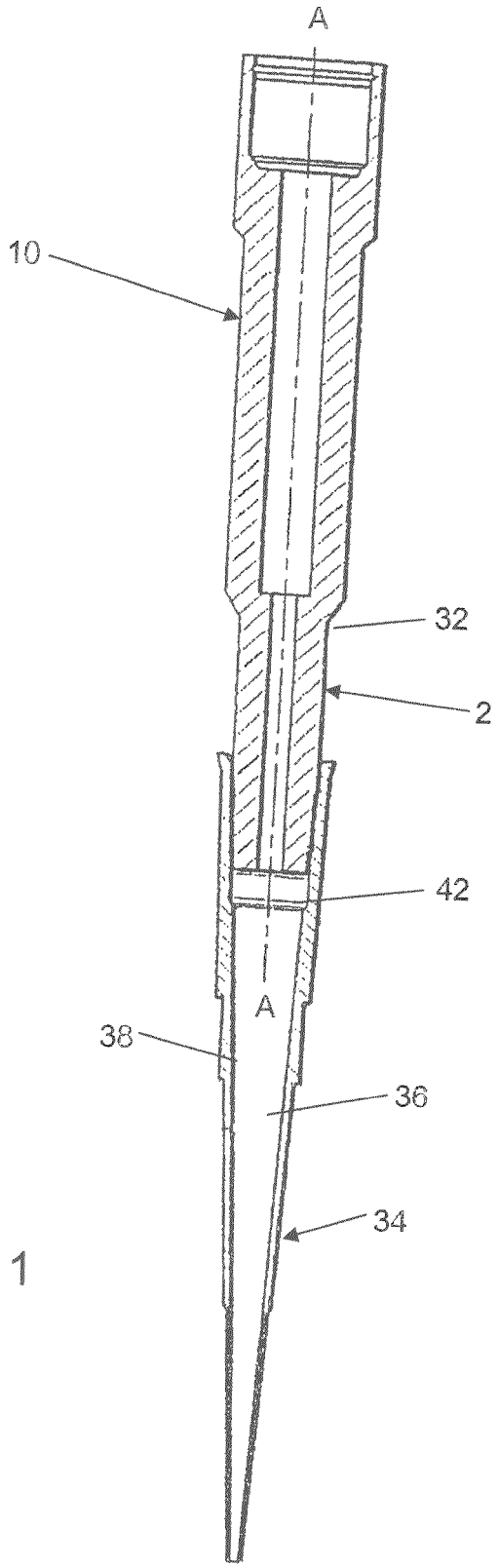
FIG. 1 shows a longitudinal cross-sectional view of a shaft in accordance with an exemplary embodiment.
Figure 2:
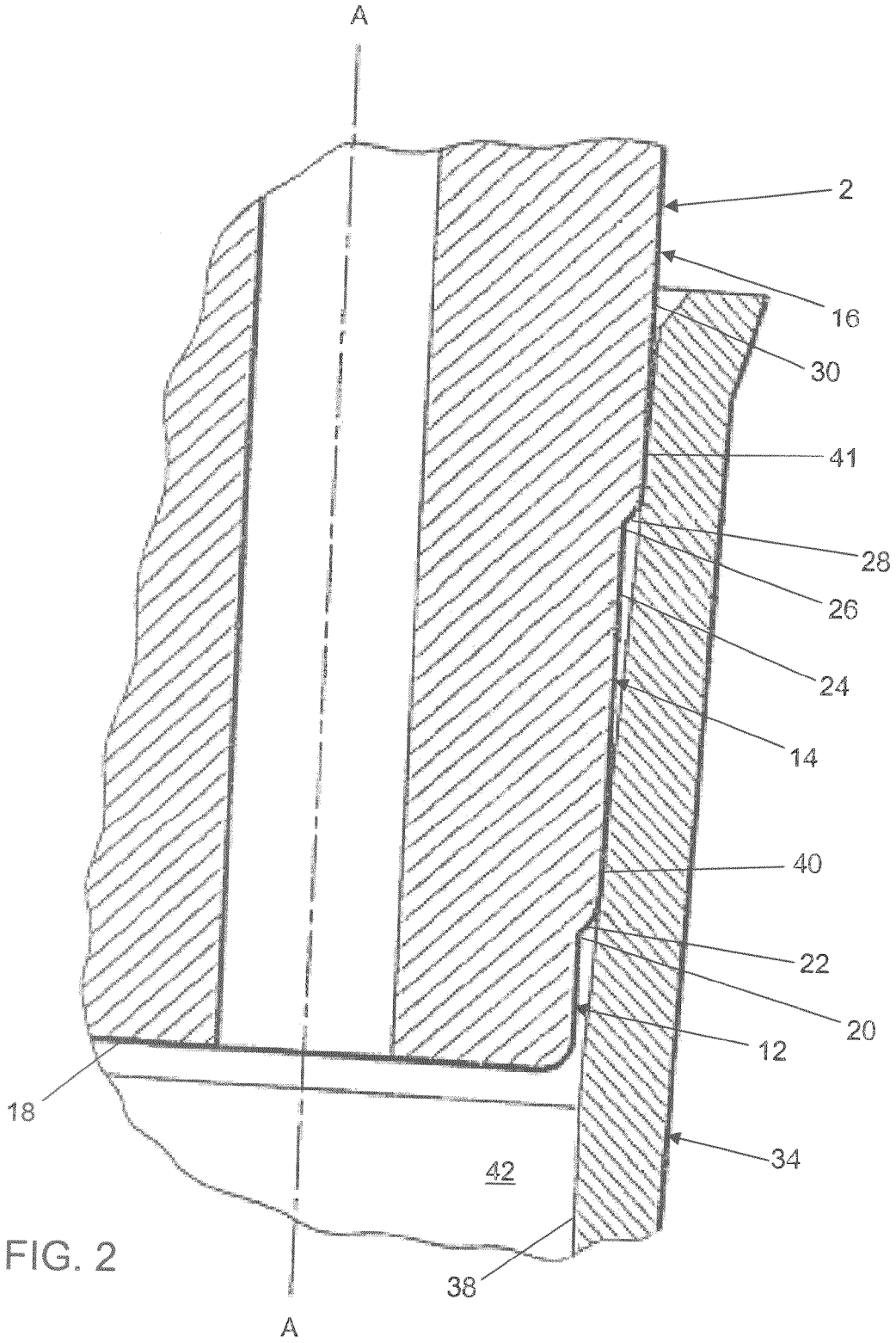
FIG. 2 shows a longitudinal cross-sectional view of a portion of the shaft of FIG. 1 in accordance with an exemplary embodiment.

With reference to FIGS. 1 and 2 a shaft 10 is shown in accordance with an exemplary embodiment. Shaft 10 may be configured to extend from a lower end of a body of a sampling pipette. Shaft 10 can be designed to be fitted on an existing pipette by replacing a removable shaft that may have a conventional configuration. Shaft 10 also can be formed as a non-removable shaft of a pipette that is of a conventional design in other respects.

A lower terminal part 2 of shaft 10, according to the exemplary embodiment shown in FIG. 1, has a generally tapered outer shape to enable force fitting of a pipette tip 34 onto terminal part 2. Terminal part 2 of shaft 10 may include a first cylindrical portion 12, a first annular shoulder 14, and a second annular shoulder 16. First cylindrical portion 12 extends between a lower end 18 and an upper end 20. A first cross section of first cylindrical portion 12 is perpendicular to a longitudinal axis A-A of the pipette and has a first diameter.

First annular shoulder 14 includes a first transition end 22, a second cylindrical portion 24, and a first end 26 opposite first transition end 22. First transition end 22 is adjacent upper end 20 of first cylindrical portion 12. Second cylindrical portion 24 extends from first transition end 22 to first end 26. A second cross section of second cylindrical portion 24 is perpendicular to longitudinal axis A-A of the pipette and has a second diameter.

Second annular shoulder 16 includes a second transition end 28, a third cylindrical portion 30, and a second end 32 opposite second transition end 28 Second transition end 28 is adjacent first end 26 of first annular shoulder 14. Third cylindrical portion 30 extends from second transition end 28 to second end 32. A third cross section of third cylindrical portion 30 is perpendicular to longitudinal axis A-A of the pipette and has a third diameter.

There is a relatively sudden change in the outside diameter of shaft 10 at first transition end 22 such that the second diameter of second cylindrical portion 24 is greater than the first diameter of first cylindrical portion 12. There is also a relatively sudden change in the outside diameter of shaft 10 at second transition end 28 such that the third diameter of third cylindrical portion 30 is greater than the second diameter of second cylindrical portion 24.

Pipette tip 34 has an inner wall 38 that has a tapered longitudinal section in an area in which contact is made with shaft 10. Inner wall 38 defines a cavity 36. The contact area should provide the best possible seal compatible with easy ejection of pipette tip 34 when pipette tip 34 has to be replaced. The configuration and dimensions of pipette tip 34 may be conventional. For example, a cylindrical or tapered inner surface with no recesses or relief may be provided by inner wall 38 of pipette tip 34. There are not any particular requirements about the material from which pipette tip 34 is made which can be of any known nature suitable for manufacturing pipette tips. Pipette tip 34 may contain a filter 42 though this is not required.

In positioning pipette tip 34 onto shaft 10, second cylindrical portion 24 and third cylindrical portion 30 come into contact with inner wall 38 of pipette tip 34 when pipette tip 34 is force fitted onto shaft 10 Second cylindrical portion 24 contacts inner wall 38 of pipette tip 34 at a first contact area 40. Third cylindrical portion 30 contacts inner wall 38 of pipette tip 34 at a second contact area 41. Second cylindrical portion 24 and third cylindrical portion 30 maintain pipette tip 34 on shaft 10 more efficiently than using a conventional shaft arrangement whereby a diameter of terminal part 2 of shaft 10 is progressively and continuously reduced towards lower end 18.

First transition end 22 and second transition end 28 correspond to a reduction in the diameter of shaft 10 in the range of approximately 0.2 to approximately 2 millimeters (mm). Preferably, the reduction in the diameter of shaft 10 provided by first transition end 22 and second transition end 28 is in the range of approximately 0.3 to approximately 1.8 mm. Preferably, first transition end 22 and second transition end 28 do not have a sharp angle, but are rounded to facilitate force fitting of pipette tip 34.

Typically, the reduction in the diameter of shaft 10 provided by first transition end 22 and second transition end 28 is made over a length in the range of approximately 0.2 to approximately 5 mm, and preferably, in the range of approximately 0.5 to approximately 3 mm. First annular shoulder 14 and second annular shoulder 16 extend over a length ranging from approximately 2 mm to approximately 8 mm in the direction of longitudinal axis A-A. Preferably, first annular shoulder 14 and second annular shoulder 16 extend over a length ranging from approximately 3.5 mm to approximately 6 mm in the direction of longitudinal axis A-A. The precise choice of these dimensions depends largely on the characteristics of the pipette tips used.

The purpose of second annular shoulder 16 is to form a centering device for pipette tip 34 during force fitting and to form a progressive stop. The purpose of first annular shoulder 14 is to seal the contact between pipette tip 34 and shaft 10. As a result first contact area 40 between second cylindrical portion 24 and pipette tip 34 provides the highest localized deformation of pipette tip 34.

Figure 3:
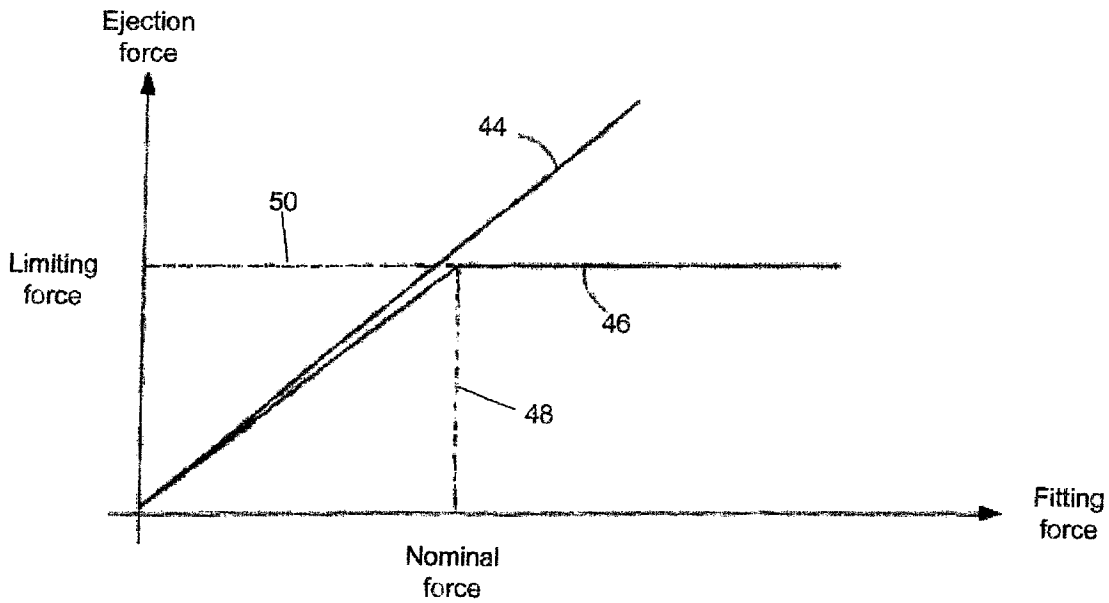
FIG. 3 shows ejection force curves comparing a conventional pipette shaft to the shaft of FIG. 1 in accordance with an exemplary embodiment.

Using first annular shoulder 14 and second annular shoulder 16, the geometry of the contact between pipette tip 34 and shaft 10 is more reliable because the quality of this contact becomes much more dependent on the force applied by the user during the force fitting operation of pipette tip 34 than it was using prior art shafts A high fitting force does not cause significantly greater penetration of terminal part 2 of shaft 10 into pipette tip 34 than using a lower fitting force largely due to the existence of the stop provided by second contact area 41 of second annular shoulder 16 As a result, when it is required to eject pipette tip 34 from shaft 10 the ejection force that has to be exerted is generally equal to a clearly determined value as shown with reference to FIG. 3. FIG. 3 qualitatively and diagrammatically shows the ejection force that has to be applied to pipette tip 34 as a function of the fitting force that was exerted while pipette tip 34 was force fitted onto shaft 10. In the case of a conventional shaft, first curve 44 represents the required ejection force which increases approximately linearly with the fitting force applied. In accordance with the exemplary embodiment of shaft 10, second curve 46 represents the required ejection force as a function of the fitting force applied. Due to the presence of second contact area 41 of second annular shoulder 16 which acts as a stop for force fitting of pipette tip 34, there is a nominal fitting force 48 that corresponds to a force limit 50, beyond which an increase in the fitting force no longer has any effect on the position of pipette tip 34. Therefore, even where a fitting force exceeds nominal fitting force 48, the required ejection force remains approximately equal to force limit 50. Thus, a precise ejection force equal to force limit 50 can be applied to eject pipette tip 34 simply by applying a fitting force greater than nominal fitting force 48. The fitting force does not have to be determined more precisely, yet a successful seal and ejection are more easily guaranteed. Shaft 10 can be used with single-channel or until channel pipettes.

Figure 4:
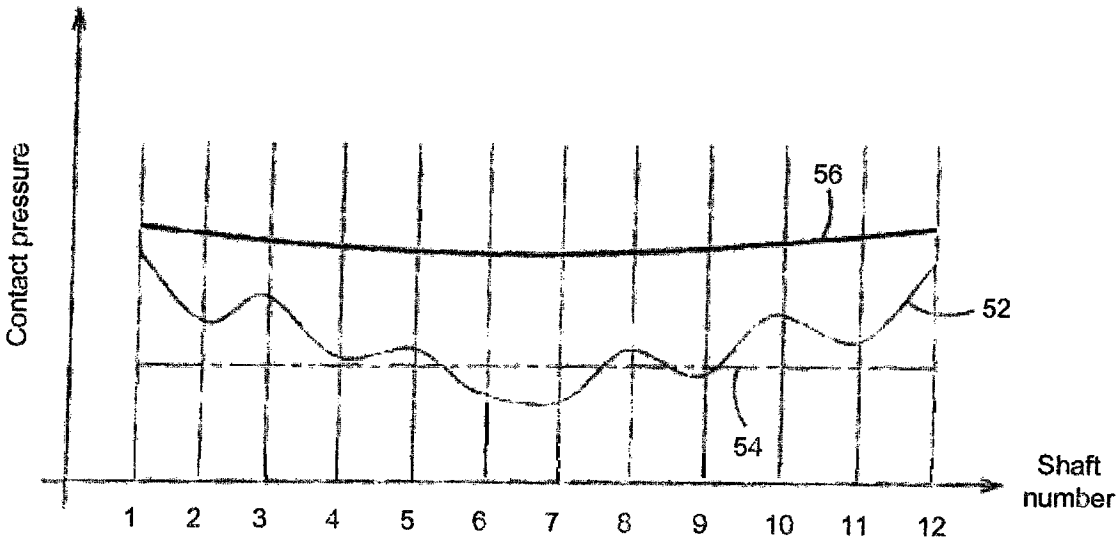
FIG. 4 shows contact pressures for a plurality of shafts of a multi-channel pipette in accordance with an exemplary embodiment.

The sealing area provided by first contact area 40 between first annular shoulder 14 and inner wall 38 of pipette tip 34 has a smaller surface area than in the case of the conventional smooth configuration of terminal part 2 of shaft 10. Therefore, the contact pressure at the sealing area is higher, which results in a reliable and reproducible seal. Additionally, the position of this sealing area is well controlled. These advantages are particularly important for multi-channel pipettes for which it is often very difficult to obtain identical and satisfactory sealing conditions at each tip. This characteristic is illustrated in FIG. 4 which qualitatively shows the contact pressure at the sealing area on each of the shafts. A third curve 52 indicates, for each shaft, a pressure measured after simultaneously force fitting pipette tips on twelve shafts of a conventional multi-channel pipette. Third curve 52 indicates that the contact pressure is highly variable from one shaft to another and that the highest pressures are achieved for shafts located in the side areas of the conventional multi-channel pipette. A fourth curve 54 indicates a minimum value of the contact pressure that is necessary to achieve a good seal. As shown with reference to FIG, 4, there is a risk that the minimum value of the contact pressure necessary to achieve a good seal might not be achieved on shafts particularly in the middle part of the conventional multi-channel pipette. A fifth curve 56 shows the contact pressure measured at the sealing areas of each of the twelve shafts of a second multi-channel pipette wherein the shape of the shafts of the second multi-channel pipette complies with the exemplary embodiment of shaft 10. The pipette tips applied on the twelve shafts of the conventional multi-channel pipette were identical to the pipette tips applied on the twelve shafts of the second multi-channel pipette. It can be seen that the values of the contact pressure are significantly higher for the second multi-channel pipette than for the conventional multi-channel pipette due to the smaller surface area of the sealing area. Additionally, it can be seen that the value of the contact pressure is much more uniform across all shafts for the second multi-channel pipette than for the conventional multi-channel pipette. This assures a satisfactory seal for all shafts.

Additional annular shoulders can be included on terminal part 2 of shaft 10. The quality of the seal would be the same and shaft 10 would be just as tolerant to small differences on the inside dimensions of pipette tip 34 compared with nominal dimensions.

The foregoing description of exemplary embodiments have been presented for purposes of illustration and of description. It is not intended to be exhaustive or to limit the invention to the precise form disclosed, and modifications and variations are possible in light of the above teachings or may be acquired from practice of the invention. The embodiments were chosen and described in order to explain the principles of the invention and as practical applications of the invention to enable one skilled in the art to utilize the invention in various embodiments and with various modifications as suited to the particular use contemplated. It is intended that the scope of the invention be defined by the claims appended hereto and their equivalents.

What is claimed is:

1. A shaft for a sampling pipette, the shaft comprising:

a first cylindrical portion configured to extend from a lower end of a pipette, wherein a first cross section of the first cylindrical portion is perpendicular to a longitudinal axis of the pipette and has a first diameter, the first cylindrical portion including an upper end opposite the lower end;

a first annular shoulder including a first transition end adjacent the upper end of the first cylindrical portion;

a second cylindrical portion, wherein a second cross section of the second cylindrical portion is perpendicular to the longitudinal axis of the pipette and has a second diameter; and a first end opposite the first transition end, the second cylindrical portion extending from the first transition end to the first end; and a second annular shoulder including a second transition end adjacent the first end of the first annular shoulder;

a third cylindrical portion, wherein a third cross section of the third cylindrical portion is perpendicular to the longitudinal axis of the pipette and has a third diameter; and a second end opposite the second transition end, the third cylindrical portion extending from the second transition end to the second end;

wherein the second diameter is greater than the first diameter;

wherein the third diameter is greater than the second diameter;

wherein the second diameter and the third diameter are selected so that a pipette tip contacts at least a portion of the second cylindrical portion to provide a seal and at least a portion of the third cylindrical portion to provide a progressive stop when the pipette tip is mounted on the shaft; and further, wherein a difference between the third diameter and the second diameter is in the range of approximately 0.2 millimeters and approximately 2 millimeters.

2. The shaft of claim 1, wherein the difference is between 0.3 millimeters and 1.8 millimeters.

3. The shaft of claim 1, wherein the first transition end and the second transition end are rounded.

4. The shaft of claim 1, wherein the first transition end and the second transition end extend over a length of 0.2 millimeters to 5 millimeters in the direction of the longitudinal axis.

5. The shaft of claim 4, wherein the first transition end and the second transition end extend over a length of 0.5to 3 millimeters in the direction of the longitudinal axis.

6. The shaft of claim 1, wherein the first annular shoulder and the second annular shoulder extend over a length of 2 millimeters to 8 millimeters in the direction of the longitudinal axis.

7. The shaft of claim 6, wherein the first annular shoulder and the second annular shoulder extend over a length of 3.5 millimeters to 6 millimeters in the direction of the longitudinal axis.

8. The shaft of claim 1, wherein a difference between the second diameter and the first diameter is between 0.2 millimeters and 2 millimeters.

9. The shaft of claim 8, wherein a difference between the second diameter and the first diameter is between 0.3 millimeters and 1.8 millimeters.

10. A sampling pipette comprising:

a pipette body; and a shaft extending from the pipette body, the shaft comprising a first cylindrical portion configured to extend from a lower end of the pipette body, wherein a first cross section of the first cylindrical portion is perpendicular to a longitudinal axis of the pipette body and has a first diameter, the first cylindrical portion including an upper end opposite the lower end;

a first annular shoulder including a first transition end adjacent the upper end of the first cylindrical portion;

a second cylindrical portion, wherein a second cross section of the second cylindrical portion is perpendicular to the longitudinal axis of the pipette body and has a second diameter; and a first end opposite the first transition end, the second cylindrical portion extending from the first transition end to the first end; and a second annular shoulder including a second transition end adjacent the first end of the first annular shoulder;

a third cylindrical portion, wherein a third cross section of the third cylindrical portion is perpendicular to the longitudinal axis of the pipette body and has a third diameter; and a second end opposite the second transition end, the third cylindrical portion extending from the second transition end to the second end;

wherein the second diameter is greater than the first diameter;

wherein the third diameter is greater than the second diameter;

wherein the second diameter and the third diameter are selected so that a pipette tip contacts at least a portion of the second cylindrical portion to provide a seal and at least a portion of the third cylindrical portion to provide a progressive stop when the pipette tip is mounted on the shaft; and further, wherein a difference between the third diameter and the second diameter is in the range of approximately 0.2 millimeters and approximately 2 millimeters.

11. The sampling pipette of claim 10, wherein the difference is between 0.3 millimeters and 1.8 millimeters.

12. The sampling pipette of claim 10, wherein the first transition end and the second transition end extend over a length of 0.2 millimeters to 5millimeters in the direction of the longitudinal axis.

13. The sampling pipette of claim 12, wherein the first transition end and the second transition end extend over a length of 0.5 to 3 millimeters in the direction of the longitudinal axis.

14. The sampling pipette of claim 10, wherein the first annular shoulder and the second annular shoulder extend over a length of 2 millimeters to 8millimeters in the direction of the longitudinal axis.

15. The sampling pipette of claim 14, wherein the first annular shoulder and the second annular shoulder extend over a length of 3.5 millimeters to 6 millimeters in the direction of the longitudinal axis.

16. The sampling pipette of claim 10, wherein a difference between the second diameter and the first diameter is between 0.2 millimeters and 2 millimeters.

17. The sampling pipette of claim 10, wherein the sampling pipette is a multi-channel pipette.

18. The sampling pipette of claim 10, wherein the first transition end and the second transition end are rounded.

* * * * *